US005954306A

United States Patent [19]

Hoover

[11] Patent Number: 5,954,306

[45] Date of Patent: Sep. 21, 1999

[54] WALL BRACKET HAVING LOCKING ROD

[76] Inventor: Scott A. Hoover, 621 E. St., Clearwater, Fla. 34616

[21] Appl. No.: 09/139,736

[22] Filed: Aug. 25, 1998

[51] Int. Cl.[6] ..... E04G 3/08

[52] U.S. Cl. ..... 248/250; 108/108

[58] Field of Search ..... 248/250, 239, 248/235, 240, 240.1, 231.9, 249; 108/108, 152

[56] References Cited

U.S. PATENT DOCUMENTS

| | | | |
|---|---|---|---|
| 1,767,316 | 6/1930 | Sealey | 248/239 |
| 1,789,126 | 1/1931 | Aldeen . | |
| 1,799,602 | 4/1931 | North et al. . | |
| 1,877,343 | 9/1932 | Malby . | |
| 2,036,884 | 4/1936 | Reeves . | |
| 2,098,997 | 11/1937 | Bramming . | |
| 2,130,536 | 9/1938 | Chaffee . | |
| 2,542,753 | 2/1951 | Swart . | |
| 3,273,844 | 9/1966 | Hodson et al. . | |
| 3,782,238 | 1/1974 | Polos . | |
| 4,441,433 | 4/1984 | Caldwell | 108/152 |
| 5,788,200 | 8/1998 | Jones | 248/235 |

*Primary Examiner*—Ramon O. Ramirez
*Attorney, Agent, or Firm*—Dennison, Meserole, Scheiner & Schultz

[57] ABSTRACT

A support system for a shelf including a bracket for mounting to a stud wall wherein a first leg of the bracket engages against the inner face of the near wall panel and a second leg, rigid with the first leg, projects forwardly beyond the forward face of the wall panel. The projecting leg receives an elongate rigid lock rod therethrough with the rod extending across the thickness of the stud wall and engaging the far wall panel. The shelf includes a bore extending inward from the rear edge thereof which receives and conceals the projecting bracket leg.

17 Claims, 2 Drawing Sheets

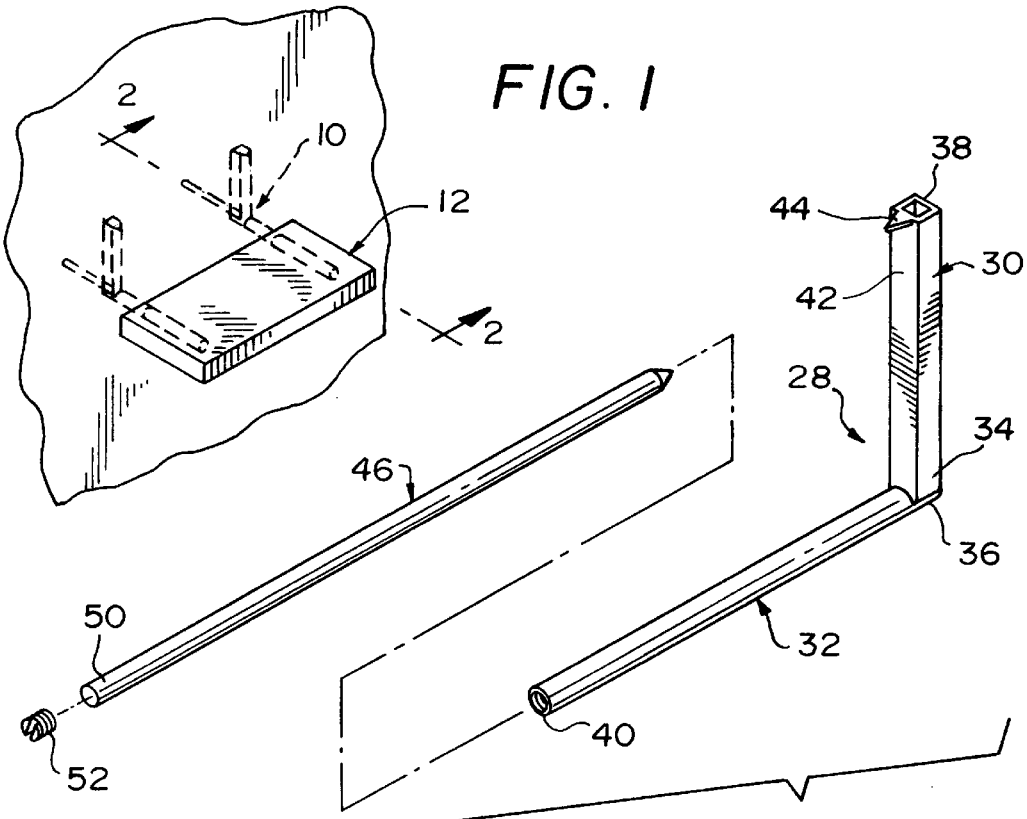
FIG. 1
FIG. 3
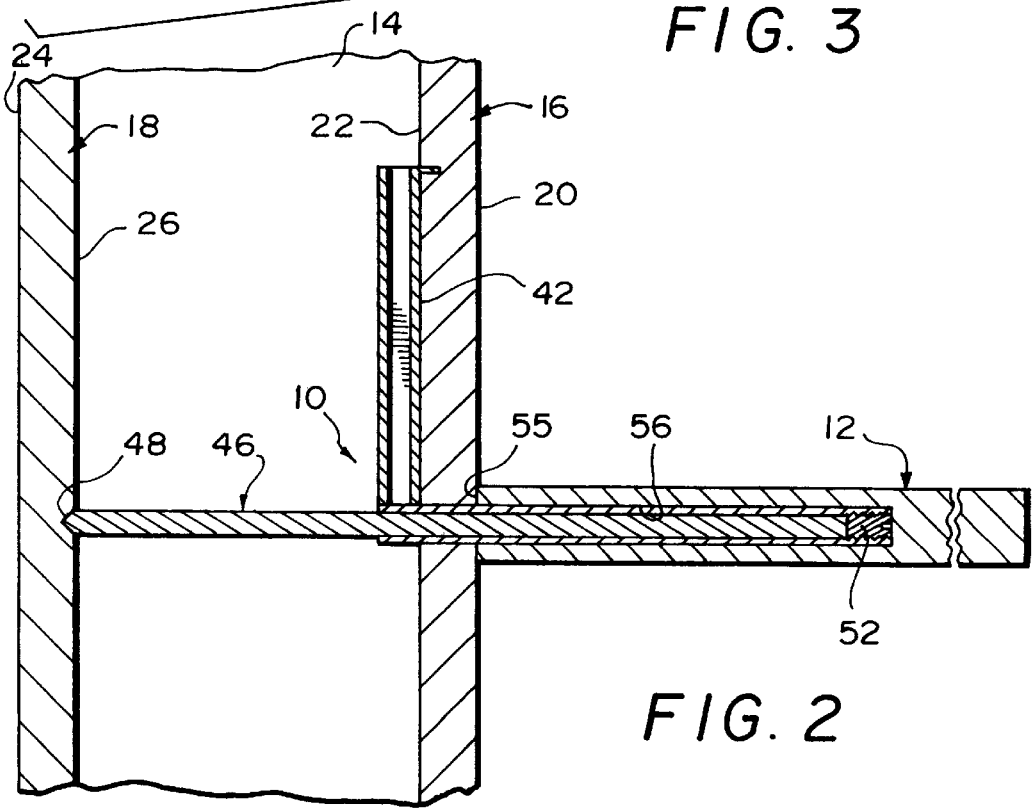
FIG. 2

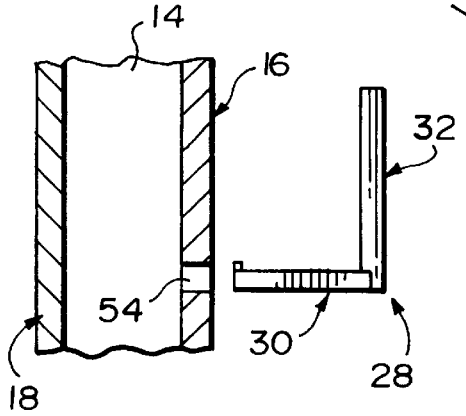
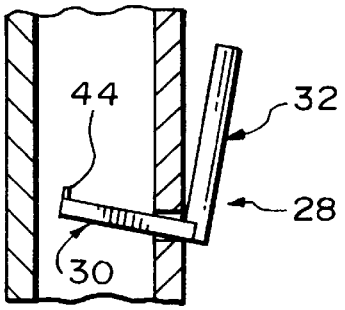
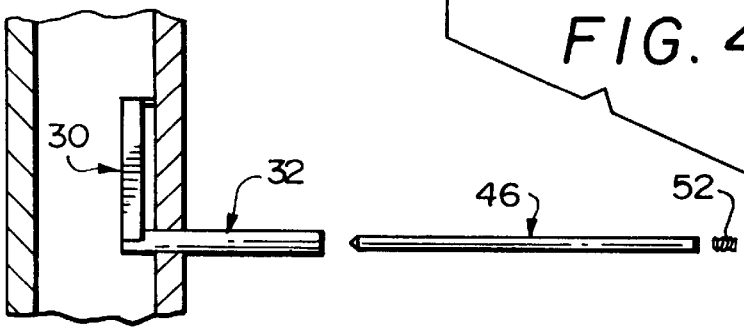
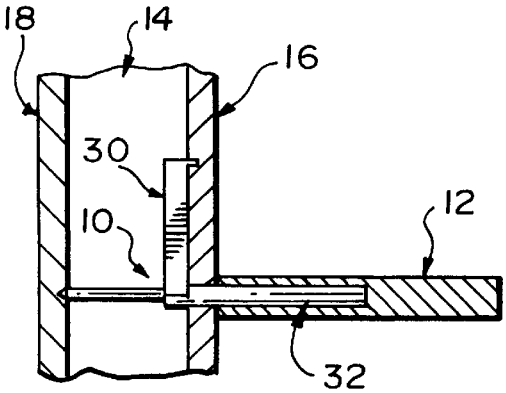
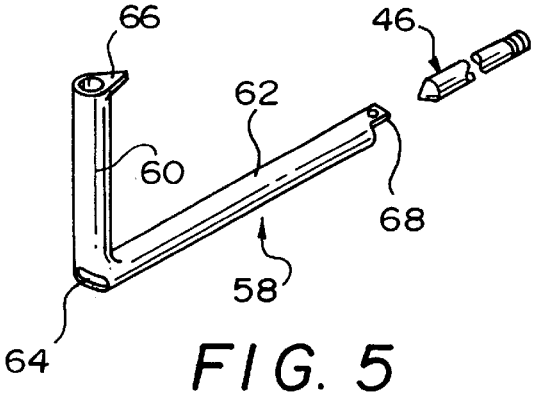
FIG. 5
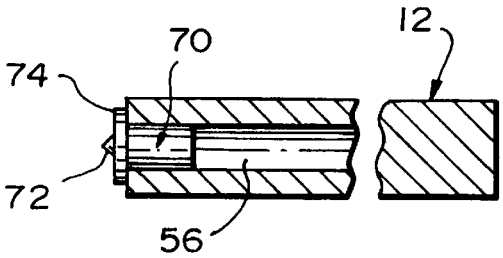
FIG. 6
FIG. 4

WALL BRACKET HAVING LOCKING ROD

BACKGROUND OF THE INVENTION

Wall brackets, that is brackets mounted to a wall or the like are commonly employed for a variety of purposes, including the mounting of shelves, wall hangings, and the like. Such brackets are normally exposed to at least some degree and, while in some instances may be decorative in themselves, are frequently merely a utilitarian device, the exposure of which actually detracting from the appearance of the supported item.

One common form of bracket or hanger element is that normally associated with pegboards wherein a vertical portion of the bracket is inserted horizontally through a hole in the pegboard and pivoted vertically to engage the rear face of the board while simultaneously engaging the front face of the same board. The supported item rests or is hung from the forwardly projecting leg of such a bracket with the entire load borne by the single board. Variations on such brackets will also be noted in the following patents:

| | |
|---|---|
| U.S. Pat. No. 2,542,753 | J. De Swart |
| U.S. Pat. No. 3,273,844 | R. J. Hodson et al |

SUMMARY OF THE INVENTION

The bracket of the present invention and the support system utilizing the bracket are particularly intended to mount to a hollow core wall, such as a standard stud supported wall with wall board panels mounted to the opposite faces of the studs. The wall engaging portion of the bracket is positioned between the opposed wall panels engaged with each wall panel, with the supporting portion of the bracket extending outward from the wall panel on which the shelf or other item is to be mounted.

In a preferred embodiment, the shelf is so configured as to internally receive the support leg of the bracket and thus completely conceal the bracket and give the appearance of the shelf mounting to the wall without a physically or visibly encumbering support system.

In order to achieve the objects of the invention, the bracket includes the first component comprising a pair of elongate rigid legs having rigidly joined inner ends and remote outer ends. The legs are preferably linear and, for mounting on the conventional vertical wall, at right angles to each other. This angular relationship can vary depending upon the inclination of the wall to which the bracket is to be mounted in order to retain the projecting support leg horizontally or as close thereto as deemed necessary for a proper support and positioning of the item mounted thereto.

The vertical anchor leg will preferably include a planar forward face and an anchor prong at the outer end thereof for engagement within the inner face of the near wall board. The projecting support leg will preferably be tubular and open at both the inner and outer ends thereof.

The bracket is completed by an elongate lock rod extended through the horizontal support leg and projected beyond the inner end thereof to engagement with and within the far wall panel. The lock rod is retained in this position by a threaded outer end thereon, or an appropriate set screw, threadedly engaged with the outer end portion of the support leg to both fixedly engage the inner end of the rod with the far wall board and to prevent a retraction of the lock rod. Such an arrangement also forcibly retains the anchor leg into intimate contact with the inner face of the near wall panel.

With the bracket mounted and fixed in position, the shelf, provided with an elongate bore extending inward from the inner edge thereof, is mounted to the bracket by inwardly moving the shelf to telescopically receive the support leg within the bore. As will be appreciated, when the item to be supported is a shelf, as least two brackets will required.

Other features and variations of the invention, and additional advantages derived therefrom, will become apparent from the following more detail description.

BRIEF DESCRIPTION OF THE DRAWINGS

FIG. 1 is a perspective view of a wall mounted shelf utilizing the support system of the invention;

FIG. 2 is an enlarged cross-sectional view taken substantially on a lane passing along line 2—2 in FIG. 1;

FIG. 3 is an enlarged exploded perspective view of the basic components the support bracket;

FIG. 4 is a schematic sequential illustration of the manner in which the bracket is mounted;

FIG. 5 is a perspective view of a modified form of the joined support and anchor legs; and FIG. 6 is a cross-sectional detail illustrating a positioning pin utilized to locate the mounting position for the bracket.

DESCRIPTION OF PREFERRED EMBODIMENTS

Referring now more specifically to the drawings, the bracket 10 has been illustrated as a support system for a wall mounted shelf 12. While a single bracket will be described hereinafter, it is to be appreciated that multiple brackets will normally be required, with the specific number of brackets dependent upon the length and/or weight of the shelf or other item to be supported.

The bracket 10 is specifically intended to mount to a conventional stud wall including an internal array of supporting studs 14 and spaced opposed wall panels 16 and 18, referred to as a near wall panel 16 from which the bracket 10 is to project, and a far wall panel 18 normally facing an adjacent room or area. For purposes of describing the relationship of the bracket support system to the wall, the outer and inner faces of the near wall panel 16 has been respectively designated as 20 and 22. Similarly, the outer and inner faces of the far wall panel have been designated as 24 and 26.

The bracket includes a first component 28 having a longitudinally elongate anchor leg 30 which is vertically oriented in its installed position, and a longitudinally elongate support leg 32 which, in its installed position, extends horizontally, thus defining a right angle relationship between the legs 30 and 32. The legs 30 and 32 include respective inner ends 34 and 36 rigidly fixed together, and remote respective outer ends 38 and 40. The right angle relationship between the legs 30 and 32 is to accommodate the bracket to a vertical wall and a shelf or other item to be horizontally engaged therewith. Particular circumstances, as for example a sloping wall, may require a variation in the angles between the legs.

The upright anchor leg 30 will preferably be square or rectangular in cross-section so as to present a planar forward engaging face 42 to engage flush against the inner surface or face 22 of the near wall board 16 as best seen in FIG. 2. This leg 30 will also preferably be hollow to minimize the weight of the first component 28 while maintaining substantial strength. The outer end 38 of the anchor leg 30 includes a forwardly directed prong 44 fixed thereto and extending forwardly of the planar engaging face 42 so as to pierce and intimately engage within the near wall board 16 through the inner face 22 thereof, and thus cooperate with the planar 42 in stabilizing this leg, and hence the entire bracket.

The support leg 32 is tubular and preferably cylindrical with a through passage defined therein and opening through the inner and outer ends 36 and 40 thereof. The length of this support leg is sufficient so as to extend through the near wall panel 20 and sufficiently forward thereof as to provide the desired support for the shelf 12 to be engaged therewith.

The bracket 10 further includes a second component in the nature of an elongate lock rod 46, preferably cylindrical and solid, which is slidably received through the elongate support leg 32. The rod 46 is introduced through the outer end 40 of the support leg 32 and extends beyond the open inner end 36 thereof a sufficient distance to intimately engage within the far wall panel 18 through the inner face 26 thereof. As will be appreciated from FIG. 2 in particular, the inner end 48 of the lock rod 46 will preferably be sharpened so as to embed within the far wall panel 18 to avoid any tendency for a lateral shifting therebetween.

The outer end portion 50 of the lock rod 46, when fully mounted, is located toward the outer end 40 of the support leg 32 with the hollow interior of this leg internally threaded adjacent the outer end 40 and threadedly receiving a lock element to retain the inwardly positioned lock rod. This lock element is preferably a separate set screw 52 having external threads and introduced into the thread end portion of the leg 32 after insertion of the lock rod 48 to provide the dual function of engaging the lock rod 46 and inwardly driving the pointed end 48 thereof into intimate engagement with the far wall panel 18, and at the same time providing for a positive abutment preventing a withdrawal of the lock rod 46. It will also be recognized that this inward driving of the lock element set screw 52 also effects a corresponding forward pull on the support leg 32 and a corresponding forward encouraging movement of the anchor leg into intimate engagement with the inner face 22 of the near wall panel 16. The cross-sectional dimension of the lock rod 46 is such as to freely slide through the threaded end portion of the support leg 32. As an alternative to the use of the set screw, the outer end portion of the lock rod 46 can itself be slightly enlarged and threaded to itself threadedly engage the threaded outer end portion of the interior of the support leg 32. In such instance, an appropriate screw kerf or drive socket will be provided in the outer end 50 of the lock rod 46.

FIG. 4 illustrates, schematically, the mounting sequence of the bracket 10 within a preformed hole 54 in the near wall panel 16. First, the anchor leg 30 is inserted horizontally through hole 54, the component 28 is then pivoted about the joined inner ends of the legs to bring the anchor leg 30 vertical and the upwardly directed with the forward face 42 toward the inner surface 22 of the wall panel and with the anchoring prong 44 engaged thereagainst. The support leg 32 is pulled forward to at least partially embed the prong. So positioned, the support leg 32 is horizontally positioned and extends forwardly or outwardly of the front face 20 of the near wall panel 16. At this point, the lock rod 46 is introduced through the support leg 32, engaged against the inner face 26 of the far wall panel 18, and driven into piercing engagement with the far wall panel 18 by the set screw 52 or like element threaded into the outer end portion of the support leg 32. This setting of the lock rod will, by a reaction force, further and fully embed the prong 44 and position the forward face 42 in intimate engagement with the wall panel face 22. The bracket 10, thus mounted and preferably in conjunction with one or more aligned additional brackets, is set to receive the shelf 12 or other supported item.

As it is a principal object of the invention to mount the shelf 12 with the bracket and bracket mounting system completely concealed, the shelf, through the near edge 55 thereof is provided with an inwardly directed bore 56 of a depth so as to slidably and fully receive the projecting portion of the support rod 32 therein, with the rear edge 54 of the shelf engaged flush against the front face 20 of the near wall panel 16. The resultant appearance will be that of the shelf extending from the wall without any visible means of support or engagement of the shelf with the wall.

FIG. 5 illustrates a variation of the bracket wherein the first component 58 is formed of a single tubular member bent at right angles with the integral inner ends of the anchor and support legs 60 and 62 cut away to define an opening 64 aligned with the hollow interior of the support leg 62. An appropriate anchor prong 66 is formed integral with the outer end portion of the anchor leg 60 at the outer end thereof and inwardly directed into overlying relation to the support leg 62. The cylindrical stock from which the component 58 is formed will not in itself provide a planar forward face, such as face 42, for engagement with the inner surface 22 of the near wall panel 16. However, if the additional advantage of such a planar forward face are desired, the manufacturing process can include the step of slightly flattening the vertical forwardmost extent of the anchor leg 60. In all cases, while not strictly limited thereto, it is preferred that the horizontally extending support leg, 32 and 62, be cylindrical with the companion shelf bore 56 similarly of a cylindrical configuration whereby any slight rotational misalignment, as for example where the vertical anchor leg slightly rotated off to one side of the exact vertical, the cylindrical support leg will be equally receivable within the shelf bore.

As another manner of using the bracket, it is possible to provide for a direct supporting of the shelf on top of the support legs of multiple brackets. In this case, it is obvious that the bracket support leg will be exposed. Further, and noting FIG. 5, in order to retain the shelf on the support leg, a forwardly extending tab 68, on the outer end of the support leg, can be provided with a screw receiving aperture vertically therethrough to accommodate a screw therethrough and into the overlying shelf to fix the shelf to the bracket. Provision can also be made, by means of a vertical threaded bore through the bottom of the shelf and into the shelf bore 56 to engage the bore-received support leg, and thus directly lock the shelf thereto. Retention of the shelf against accidental removal can also be achieved by providing for a snug frictional engagement of the support leg within the shelf bore whereby positive manual force would be required to withdraw the shelf. In a further variation, the first bracket component may be a permanent part of the shelf with the support leg of the bracket component within a bore which extends to and through the forward edge of the shelf. In such an arrangement, the lock rod will be of a length which allows it to be inserted through the front edge of the shelf and through and beyond the support rod for embedded engagement with the far wall panel. The rod retaining set screw can be threaded within the forward portion of the shelf bore and the forward edge hole closed by an appropriate matching plug. If desired, a shelf with the bore accessible through the front edge thereof can also be used on a separately mounted bracket.

Noting FIG. 6, as an initial step in mounting the shelf 12, it is essential that the bracket mounting wall openings 54 be properly located. Accordingly, each shelf bore 56 is provided with a locator plug 70 removably received within the open end of the bore 56 and including an outwardly directed marking element or pin 72 and a collar 74 to limit movement of the plug into the bore. The shelf, utilizing appropriate measuring means, levels, and the like, is then properly positioned on the wall and the shelf inner edge forced against the wall wherein the marking element marks or pierces the wall at the appropriate location for the wall panel hole or holes 54. The locator plugs are then removed, the hole drilled, and the bracket installed as above described.

The foregoing description of preferred and related embodiments are not intended to limit the scope of the invention. Rather, and as other embodiments and variations may reasonably occur to those skilled in the art, the invention is only to be limited by the scope of the claims following hereinafter.

I claim:

1. A support system for a wall mounted item, said system comprising a bracket having a support leg with opposed inner and outer ends, an anchor leg extending at an angle from said support leg and having an inner end rigidly fixed to said inner end of said support leg, and an outer end, a lock rod slidably mounted to said support leg for selective extension of a first end of said rod from said inner end of said support leg to an extended position at a point beyond said anchor leg, and means for fixing said lock rod to said support leg against retraction of said first end of said rod from the extended position thereof.

2. The support system of claim 1 wherein said support leg is hollow and opens through the inner and outer ends thereof, said lock rod being slidably received within said hollow support leg.

3. The support system of claim 2 wherein said anchor leg has a planar face defining a longitudinal side of said anchored leg, said support leg extending from the side of the anchor leg defined by said planar face.

4. The support system of claim 3 wherein said anchor leg is of a hollow rectangular cross-section along the length thereof.

5. The support system of claim 4 wherein said outer end of said anchor leg includes a laterally directed piercing prong formed thereon and extending in generally overlying aligned relation to said support leg.

6. The support system of claim 5 wherein said outer end of said support leg includes a longitudinally extending generally planar tab having an aperture defined transversely therethrough for reception of a driven fastener.

7. The support system of claim 1 wherein said outer end of said anchor leg includes a laterally directed piercing prong formed thereon and extending in generally overlying aligned relation to said support leg.

8. The support system of claim 7 wherein said outer end of said support leg includes a longitudinally extending generally planar tab having an aperture defined transversely therethrough for reception of a driven fastener.

9. A method of mounting a support bracket to spaced generally parallel near and far wall panels, said bracket having a support leg and an anchor leg fixed thereto and extending at a generally right angle therefrom, and a lock rod slidably mounted to said support leg and selectively extendible therefrom beyond said anchor leg, and a hole defined through said near wall panel;

said method comprising the steps of inserting said anchor leg through said wall panel hole, rotating the support leg to project forward of said hole at a desired angle, bringing said anchor leg into engagement with the inner face of said near wall panel, slidably extending said lock rod along said support leg, through said hole and into engagement with said far wall panel, and fixing said lock rod to said support leg with said lock rod engaged with said far wall panel.

10. A wall shelf and a support bracket for mounting said shelf on a wall, said wall having a wall support structure mounting a near wall panel and a far wall panel generally parallel to said near wall panel, said bracket comprising an elongate anchor leg having inner and outer ends and an elongate support leg having an inner end rigid with said inner end of said anchor leg and extending at generally right angles to said anchor leg, means adapted to engage said anchor leg with said near wall panel with said support leg adapted to engage outward from said near wall panel, a lock rod slidably mounted to said support leg for selectively extendible therefrom inward of said near wall panel and into engagement with said far wall panel, said shelf having a rear portion adapted to engage with said near wall panel, and a bore defined in said shelf through said rear portion and slidably receiving said support leg therein.

11. The construction of claim 10 wherein said near wall panel has an outer face from which said support leg extends and an inner face facing said far wall panel, said anchor leg adapted to extend against said inner face of said near wall panel with said support leg adapted to extend therefrom through said near wall panel.

12. The construction of claim 11 including an anchoring prong rigid with the outer end of said anchor leg for piercing engagement with said near wall panel through said inner face thereof.

13. The construction of claim 12 wherein said anchor leg includes a planar face facing adapted to engage against said inner face of said near wall panel.

14. The construction of claim 11 wherein said anchor leg includes a planar face facing adapted to engage against said inner face of said near wall panel.

15. The construction of claim 11 wherein said support leg is hollow with said lock rod slidably received therethrough.

16. The construction of claim 10 including means for fixing said lock rod in a slidably adjusted position adapted to engage with said far wall panel.

17. The construction of claim 16 wherein said lock rod has a piercing point on the end thereof adapted to engage with said far wall panel.

* * * * *